US008641038B2

(12) United States Patent
Asada et al.

(10) Patent No.: US 8,641,038 B2
(45) Date of Patent: Feb. 4, 2014

(54) IMAGE RECORDING DEVICE

(75) Inventors: Tetsuo Asada, Kuwana (JP); Iwane Sano, Obu (JP); Shingo Ito, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/608,718

(22) Filed: Sep. 10, 2012

(65) Prior Publication Data

US 2013/0082437 A1 Apr. 4, 2013

(30) Foreign Application Priority Data

Sep. 30, 2011 (JP) ..... 2011-218777

(51) Int. Cl.
*B65H 1/22* (2006.01)

(52) U.S. Cl.
USPC ..... 271/164; 271/1; 271/162; 271/163

(58) Field of Classification Search
USPC ..... 271/1, 162–164; 720/719
See application file for complete search history.

(56) References Cited

U.S. PATENT DOCUMENTS

| | | | | |
|---|---|---|---|---|
| 7,101,096 | B2 * | 9/2006 | Sasai et al. | 400/48 |
| 8,002,402 | B2 * | 8/2011 | Miyauchi | 347/104 |
| 8,152,295 | B2 * | 4/2012 | Komuro et al. | 347/104 |
| 8,419,015 | B2 * | 4/2013 | Ota et al. | 271/264 |
| 2006/0170750 | A1 * | 8/2006 | Takeshita et al. | 347/104 |
| 2008/0092153 | A1 * | 4/2008 | Edwards et al. | 720/719 |
| 2011/0279625 | A1 * | 11/2011 | Cho et al. | 347/200 |
| 2012/0081760 | A1 * | 4/2012 | Asada et al. | 358/471 |
| 2013/0134660 | A1 * | 5/2013 | Idehara et al. | 271/207 |

FOREIGN PATENT DOCUMENTS

| | | | |
|---|---|---|---|
| JP | 2003-211759 | A | 7/2003 |
| JP | 2004-042410 | A | 2/2004 |
| JP | 2005-074905 | A | 3/2005 |
| JP | 2006-062848 | A | 3/2006 |
| JP | 2010-089923 | A | 4/2010 |

* cited by examiner

*Primary Examiner* — Prasad Gokhale
(74) *Attorney, Agent, or Firm* — Baker Botts L.L.P.

(57) ABSTRACT

An image recording device includes a tray configured to hold a first recording medium, an insertion guide configured to move between a guide position for guiding a second recording medium into a common path and a non-guide position, a conveyor configured to convey the tray along the common path in a first direction and to convey the second recording medium along the common path in a second direction opposite to the first direction, a recording unit configured to record an image selectively on the first recording medium and the second recording medium, a stopper disposed along the common path, and a moving unit configured to move the stopper between a retracted position and a protruding position in response to movement of the insertion guide between the non-guide position and the guide position. The stopper in the protruding position protrudes into the common path to stop the tray.

17 Claims, 14 Drawing Sheets

IMAGE RECORDING DEVICE

CROSS REFERENCE TO RELATED APPLICATION

This application claims priority from Japanese Patent Application No. 2011-218777, filed on Sep. 30, 2011, the entire disclosure of which is incorporated herein by reference.

BACKGROUND OF THE INVENTION

1. Field of the Invention

The present invention relates to an image recording device configured to record an image on a recording medium having a relatively high rigidity, such as an optical disk.

2. Description of Related Art

A known image recording device, e.g., an inkjet image recording device and a photoelectric image recording device, is configured to record an image on a recording medium based on signals input to the device.

A known image recording device comprises a media tray in which an optical disk is placed, and a manual feed tray in which a recording sheet is placed. The image recording device has an opening at the front of the device to allow the media tray to be inserted therethrough, and the manual feed tray is disposed at the rear of the devise. The media tray inserted from the front of the device and the recording sheet inserted from the rear of the device are conveyed along a common path, and an image is formed on the optical disk or the recording sheet at a position below a recording head which ejects ink.

SUMMARY OF THE INVENTION

In such an image recording device comprising the media tray and the manual feed tray, the media tray conveyed along the common path may interfere with the manual feed tray, if the media tray is conveyed toward the manual feed tray past the recording head and if the manual feed tray is configured to take different positions.

Therefore, a need has arisen for an image recording device that overcomes these and other shortcomings of the related art and is configured to prevent interference between a media tray and a manual feed tray of the image recording device.

According to an embodiment of the invention, an image recording device comprises a tray, an insertion guide, a conveyor, a recording unit, a stopper, and a moving unit. The tray is configured to hold a first recording medium. The insertion guide is configured to move between a guide position for guiding insertion of a second recording medium into a common path, and a non-guide position retracted from the guide position. The conveyer is configured to convey the tray from a first location to a second location along the common path in a first direction, and to convey the second recording medium from the second location to the first location along the common path in a second direction opposite to the first direction. The insertion guide is disposed in the second location. The recording unit is disposed between the first location and the conveyor, along the common path, and is configured to record an image selectively on the first recording medium held by the tray and the second recording medium. The stopper is disposed between the conveyor and the second location, along the conveying path, and is configured to move between a protruding position in which the stopper protrudes into the common path to stop conveyance of the tray and a retracted position in which the stopper is retracted from the protruding position to allow conveyance of the tray. The moving unit is configured to move the stopper between the retracted position and the protruding position in response to movement of the insertion guide between the non-guide position and the guide position, respectively.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-14B, like numerals being used for like corresponding parts in the various drawings.

In the following description, a top-bottom direction 7 is defined when a multi-function device (MFD) 10 is disposed in an orientation (shown in FIGS. 1A and 1B) in which it is intended to be used, and a front-rear direction 8 is defined such that a side having an opening 13 (shown in FIG. 1B) is positioned on the front side, and a right-left direction 9 is defined when the MFD 10 is viewed from the front side.

Figure 1A:
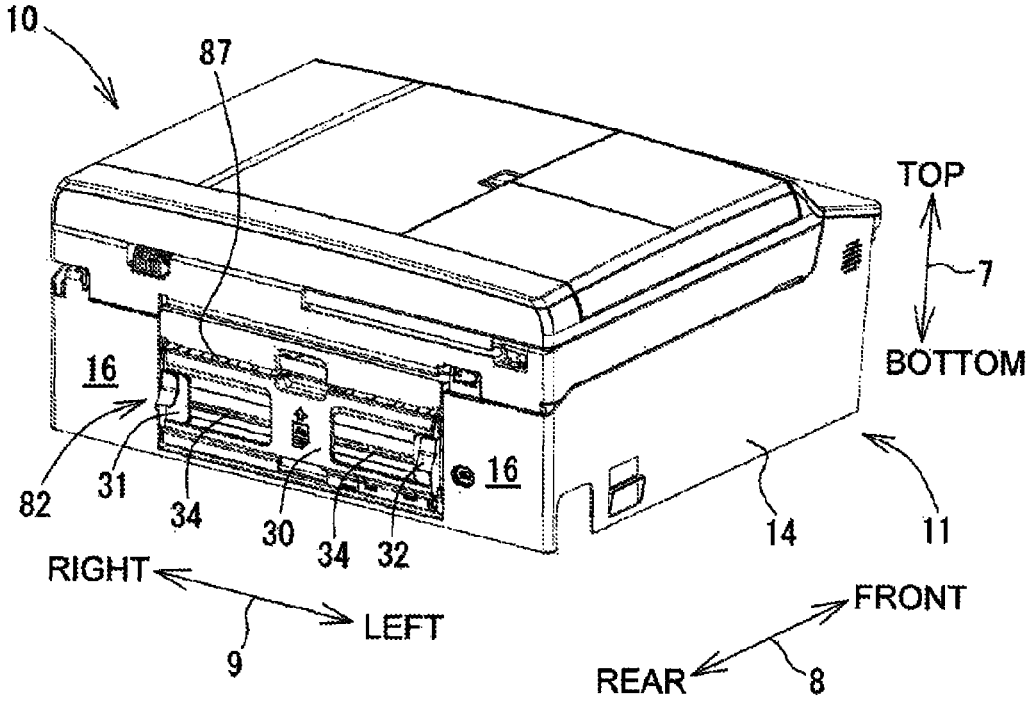
FIG. 1A is an external perspective view of a multi-function device (MFD), according to an embodiment of the invention, as viewed from the rear thereof when a manual feed tray is in a non-guide position.
Figure 1B:
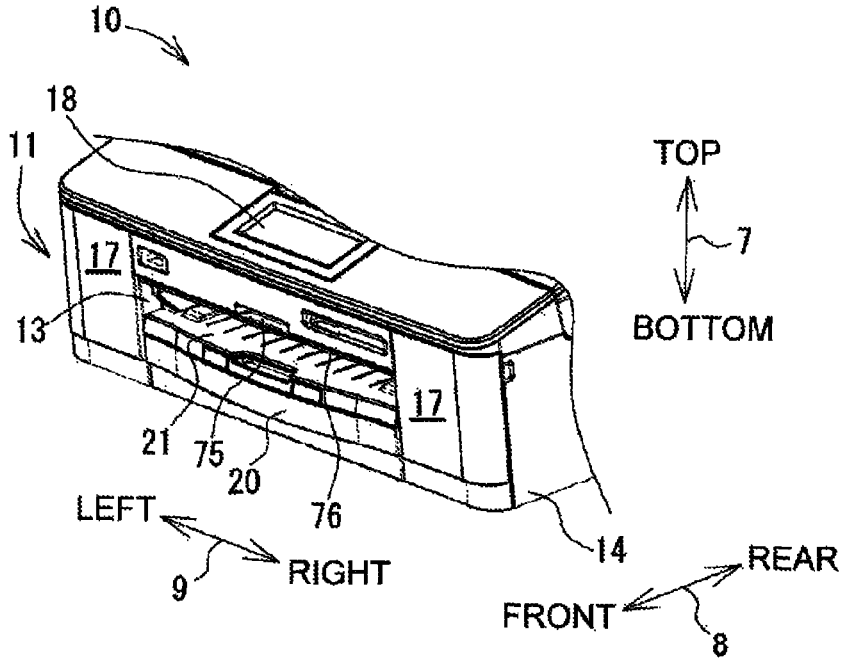
FIG. 1B is a partial external perspective view of the MFD of FIG. 1A as viewed from the front thereof.
Figure 2:
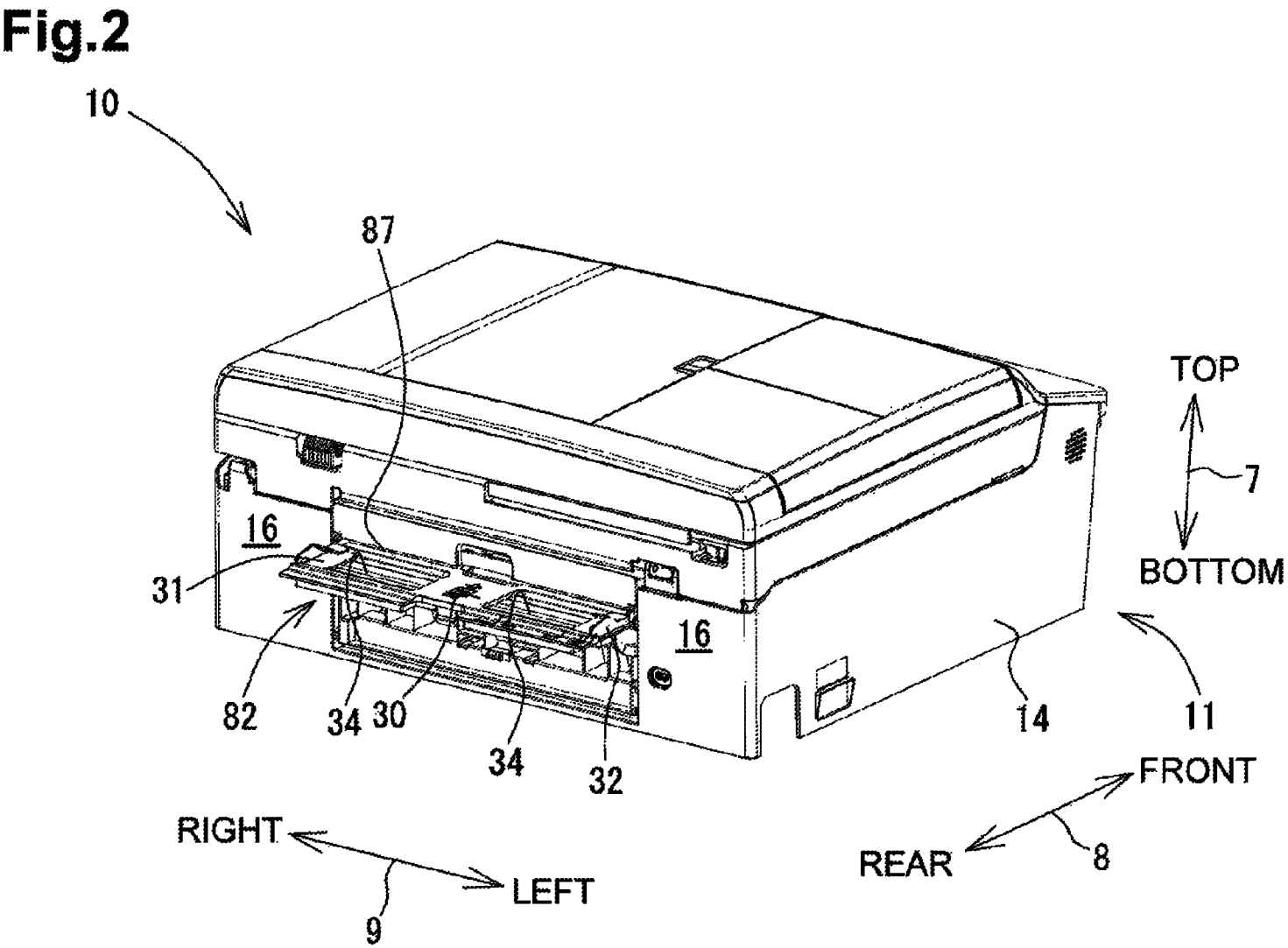
FIG. 2 is an external perspective view of the MFD of FIG. 1A as viewed from the rear thereof when the manual feed tray is in a guide position.

As shown in FIGS. 1A, 1B, and 2, an image recording device, e.g., the MFD 10, has a generally slim, rectangular parallelepiped shape. An inkjet printer 11 is disposed at a lower portion of the MFD 10. The MFD 10 has various functions such as a facsimile function and a printing function.

Figure 3:
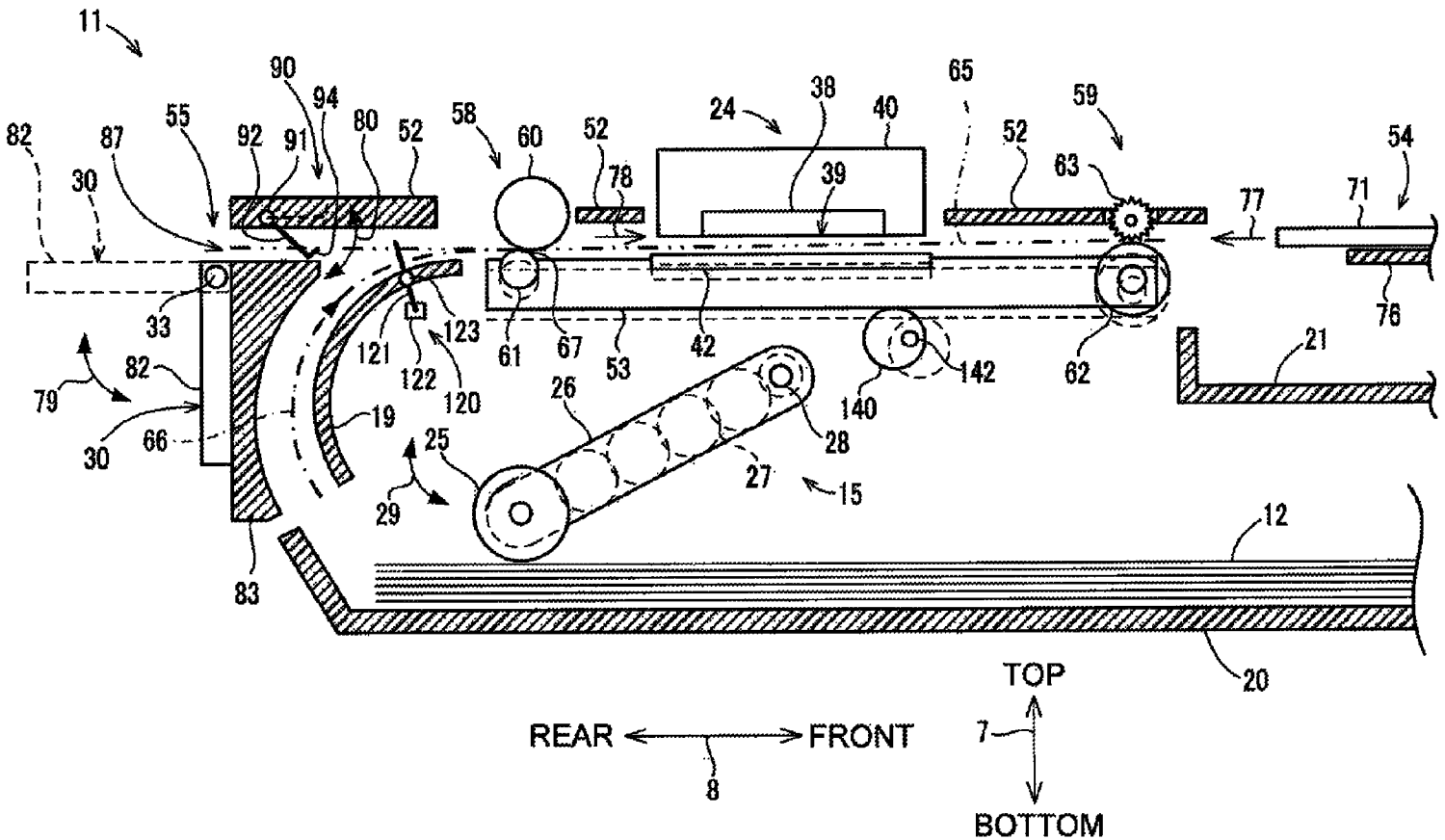
FIG. 3 is a vertical cross-sectional view schematically showing an inner structure of a printing unit of the MFD of FIG. 1A.
Figure 4B:
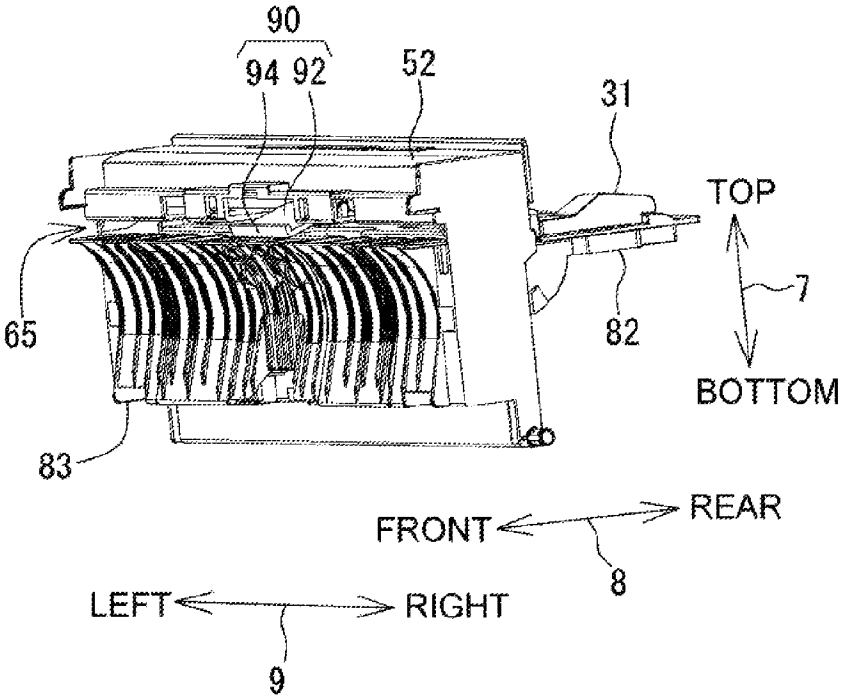
FIG. 4B is a perspective view of the upper guide member, the lower guide member, and the manual feed tray in the non-guide position, and the stopper of the printing unit of FIG. 3.
Figure 4A:
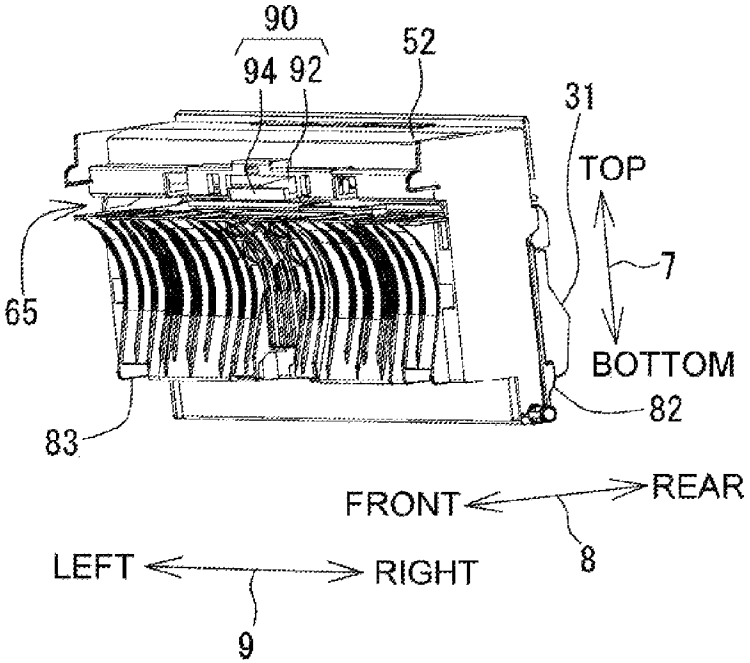
FIG. 4A is a perspective view of an upper guide member, a lower guide member, and the manual feed tray in the guide position, and a stopper of the printing unit of FIG. 3.

As shown in FIGS. 1A, 1B, and 2, the printer 11 comprises a housing 14. The housing 14 comprises, on its front side, a front wall 17 (shown in FIG. 1B) extending in the top-bottom direction 7 and in the right-left direction 9 and, on its rear side, a rear wall 16 (shown in FIGS. 1A and 2) opposite to the front wall 17. A front opening 13 is formed at a central portion of the front wall 17 to allow a feed tray 20 and a discharge tray 21 to be inserted through the front opening 13 in the front-rear direction 8. As shown in FIG. 3, a second recording medium, e.g., one or more recording sheets 12 of a desired size, is placed on the feed tray 20.

As shown in FIG. 3, the printer 11 comprises a sheet feeder 15 configured to feed a sheet 12, and a recording unit, e.g., an inkjet recording unit 24, configured to record an image on the sheet 12. The recording unit 24 may record an image on the sheet 12 based on print data received from an external device.

The MFD 10 has a function of recording an image by the recording unit 24 on a face of a first recording medium, e.g., a storage medium, such as a CD-ROM and a DVD-ROM, which is thicker than a sheet 12. In this case, a storage medium is placed on a tray, e.g., a media tray 71 formed by a resin plate having a slim, rectangular parallelepiped shape. The media tray 71 is configured to be inserted into a common path 65 from an upper side of the discharge tray 21 in a first direction, e.g., a rearward direction shown by arrow 77. The discharge tray 21 is disposed in the front opening 13. The recording function on a storage medium will be described later.

As shown in FIG. 3, the sheet feeder 15 is disposed above the feed tray 20 and comprises a roller 25, an arm 26, and a transmission 27. The roller 25 is rotatably supported at a distal end of the arm 26. The arm 26 is configured to pivot about a shaft 28 in directions shown by arrows 29 such that the roller 25 moves into contact with and away from the feed tray 20. The roller 25 is rotated by a feed motor 101 (shown in FIG. 9) via the transmission 27 which comprises a plurality of gears meshed with one another to transmit a driving force of the feed motor 101. The roller 25 is configured to separate a sheet 12 from a stack of sheets held on the feed tray 20 and feed the sheet 12 to an arcuate path 66, which will be described later.

As shown in FIG. 3, the arcuate path 66 (shown by a one-dot-one-dash line in FIG. 3) and the common path 65 (shown by a two-dot-one-dash line in FIG. 3) are defined in the printer 11. The arcuate path 66 extends from a rear end of the feed tray 20 to a conveyer, e.g., a first roller pair 58, such that a sheet 12 is guided along the arcuate path 66. The common path 65 extends from a first location, e.g., a front end 54, positioned on an upper side of the discharge tray 21 at the front opening 13 of the front wall, via the recording unit 24, to a second location, e.g., a rear end 55, positioned at a rear opening 87 of the rear wall 16. A sheet 12 and a storage medium are guided along the common path 65.

The arcuate path 66 extends from the rear end of the feed tray 20 obliquely in an upward and rearward direction, makes a U-turn frontward, and extends toward the first roller pair 58. A sheet 12 is guided along the arcuate path 66 in a conveying direction shown by an arrow in a one-dot-one-dash line in FIG. 3. The arcuate path 66 continues to the common path 65. The arcuate path 66 is defined by an inner guide member 19, an upper guide member 52, and a lower guide member 83. The inner guide member 19 is disposed opposite to the upper guide member 52 and the lower guide member 83 while leaving a predetermined clearance.

The common path 65 may extend straight in the front-rear direction 8. A sheet 12 guided along the arcuate path 66 from the feed tray 20, a sheet 12 inserted along an insertion guide, e.g., a manual feed tray 82, through the rear opening 87, and the media tray 71 on a tray guide 76 inserted through the front opening 13 are guided along the common path 65 (shown by the two-dot-one-dash line in FIG. 3).

The sheet 12, either guided along the arcuate path 66 or inserted through the rear opening 87, is guided in a second direction, e.g., a frontward direction shown by arrow 78. After the recording unit 24 records an image on the sheet 12, the sheet 12 is discharged through the front opening 13 onto the discharge tray 21.

The media tray 71 is guided in the rearward direction shown by arrow 77, and the guiding direction is reversed when a storage medium on the media tray 71 reaches a position behind the printing unit 24. Thus, the media tray 71 is guided in the direction shown by arrow 78. After the recording unit 24 records an image on the storage medium, the media tray 71 is discharged through the front opening 13. Although, in this embodiment, the recording unit 24 records an image on the storage medium when the media tray 71 is guided in the frontward direction, the recording unit 24 may record an image on the storage medium when the media tray 71 is guided in the rearward direction.

The common path 65 is defined by the upper guide member 52 and the lower guide member 83 disposed opposite to the upper guide member 52, and a platen support 53.

As shown in FIG. 3, the recording unit 24 is disposed between the front end 54 and the first roller pair 58, along the common path 65. The recording unit 24 is disposed above the common path 65. The recording unit 24 comprises a carriage 40 configured to carry a recording head 40 and to reciprocate in a main scanning direction (a direction perpendicular to the sheet plane of FIG. 3). The recording head 40 is supplied with ink from an ink cartridge (not shown) and ejects ink droplets from nozzles 39. As the carriage 40 reciprocates in the main scanning direction, the recording head 38 moves relative to the sheet 12 or the storage media and ejects ink droplets onto the sheet 12 or the storage media which are conveyed on a platen 42 along the common path 65, thereby recording an image thereron. The platen 42 for holding the sheet 12 is supported opposite to the recording unit 24 by the platen support 53.

As shown in FIG. 3, the first roller pair 58 is disposed upstream from the recording unit 24 in the direction shown by arrow 78 and comprises a first roller, e.g., a first convey roller 60 disposed above the common path 65, and a second roller, e.g., a pinch roller 61 disposed below the common path and opposite to the first convey roller 60. The pinch roller 61 is pressed into contact with a roller surface of the first convey roller 60 by an elastic member (not shown), e.g., a spring.

A second roller pair 59 is disposed downstream from the recording unit 24 in the direction shown by arrow 78 and comprises a second convey roller 62 disposed below the common path 65 and a spur 63 disposed above the common path 65 and opposite to the second convey roller 62. The spur 63 is pressed into contact with a roller surface of the second convey roller 62 by an elastic member (not shown), e.g., a spring.

The first convey roller 60 and the second convey roller 62 are rotatably driven by a convey motor 102 (shown in FIG. 9) via a transmission (not shown). The transmission comprises a planet gear and the like, and is configured to rotate the convey rollers 60, 62 such that the sheet 12 or the media tray 71 is conveyed in the direction shown by arrow 78 when the convey roller 62 rotates in one of forward and reverse directions (in the forward direction in this embodiment) and in the direction shown by arrow 77 when the convey roller 62 rotates in the other direction (in the reverse direction in this embodiment).

In other words, the convey motor 102 and the transmission apply to the first convey roller 60 and the second convey roller 62 a first driving force for conveying the sheet 12 or the media tray 71 in the direction shown by arrow 77, and a second driving force for conveying the sheet 12 or the media tray 71 in the direction shown by arrow 78. The convey motor 12 and the transmission are an example of a driving source.

The first roller pair 58 and the second roller pair 59 are configured to shift between a first state (shown by solid lines in FIG. 3) in which rollers of each pair 58, 59 are in contact with each other, and a second state (shown by broken lines in FIG. 3) in which rollers of each pair 58, 59 are spaced from each other. When the first roller pair 58 and the second roller pair 59 are in the first state, the first roller pair 58 and the second roller pair 59 are allowed to pinch the sheet 12 and to convey the sheet 12 along the common path 65. When the first roller pair 58 and the second roller pair 59 are in the second state, the first roller pair 58 and the second roller pair 59 are allowed to convey the media tray 71 along the common path 65 while a distance between rollers of each pair 58, 59 is set suitable for pinching the media tray 71. In this embodiment, shifting from the first state to the second state is achieved by moving down the pinch roller 61 and the second convey roller 62.

Although, in this embodiment, the first roller pair 58 and the second roller pair 5 are configured to pinch and convey the media tray 71 when the first roller pair 58 and the second roller pair 59 are in the second state, other configurations for conveying the media tray 71 may be used. For example, in another embodiment, the spur roller 63 of the second roller pair 59 may move up from the common path 65 and a separate roller (not shown) may move down toward the common path 65 such that the second convey roller 62 and the separate roller pinch the media tray 71. Further, in another embodiment, the pinch roller 61 may move down from the common path 65 and a separate roller (not shown) may move up toward the common path 65. In these alternative embodiments, the separate roller in place of the spur roller 63, and the separate roller in place of the pinch roller 60 are each a part of an example of the conveyer.

The platen 42 is configured to move down to a lower position from an original position. When the platen 42 is in the original position, the sheet 12 is allowed to pass between the recording unit 24 and the platen 42. When the platen 42 is in the lower position, the media tray 71 is allowed to pass between the recording unit 24 and the platen 42.

Up and down movement of the pinch roller 61, the second convey roller 62, and the platen 42 is achieved by a shifter, e.g., an eccentric cam 140 disposed below the platen 42 and the platen support 53.

The eccentric cam 140 is rotatably supported by a frame (not shown), which forms the housing 14 of the MFD 10, such that a shaft 142 of the cam 140 extends in the right-left direction 9. The eccentric cam 140 is disc-shaped and the radius of the cam 140 from the shaft 142 changes cyclically.

The platen support 53 is placed on the eccentric cam 140. The pinch roller 61 and the second convey roller 62 are rotatably supported by the platen support 53. The platen 42 is supported by the platen support 53.

In this embodiment, the eccentric cam 140 is rotatably driven by a motor (not shown). When the eccentric cam 140 rotates, a circumferential surface of the cam 140 slides against the platen support 53. As the radius from the shaft 142 to the circumferential surface changes cyclically, the platen support 53 moves in the top-bottom direction 7. As the platen support 53 moves in the top-bottom direction 7, the pinch roller 61, the second convey roller 62, and the platen 42 move in the top-bottom direction 7. In FIG. 3, the platen support 53 in an upper position is shown by solid lines, and the platen support 53 in a lower position is shown by broken lines.

In other embodiments, the platen support 53 may be actuated to move in the top-bottom direction 7 by other means than the motor. For example, the eccentric cam 140 may move in the top-bottom direction 7 in response to positional change of a tray guide 76 which will be described later. Specifically, the eccentric cam 140 may rotate to move down the platen support 53 in response to movement of the tray guide 76 to an inserting position, and to move up the platen support 53 in response to movement of the tray guide 76 to a retracted position.

As shown in FIG. 3, the tray guide 76 is disposed at the front end 54 of the printer 11. The tray guide 76 is a thin, flat plate-shaped member. As shown in FIGS. 1A and 3, the tray guide 76 is configured to move between an inserting position (shown in FIG. 3) in which the tray guide receives, on its upper surface, the media tray 71, and a retracted position (shown in FIG. 1B) in which the tray guide 76 is retracted upward from the inserting position. The position of the tray guide 76 may be changed by a user by holding a recessed portion 75, which is formed at an upper portion of the tray guide 76 in the retracted position, and by moving the recessed portion 75 in the top-bottom direction 7. The tray guide 76 comprises opposite guide plates (not shown) protruding in the right-left direction 9. The media tray 71 is inserted into the common path 65 through the front opening 13 while right and left edges of the media tray 71 are guided by the guide plates.

As shown in FIGS. 1A through 3, the manual feed tray 82 is disposed at the rear end 55 of the printer 11 to define a rear lower part of the common path 65.

As shown in FIG. 3, a first pivot shaft, e.g., a shaft 33, is disposed at an end of the manual feed tray 82 and extends in the right-left direction 9. The shaft 33 is disposed right below the rear end 55. The manual feed tray 82 extends downward from the shaft 33 and is configured to pivot about the shaft 33 in directions of arrows 79 between a guide position (shown by broken lines in FIG. 3 and shown in FIG. 2), and a non-guide position (shown by solid lines in FIG. 3 and shown in FIG. 1A). When the manual feed tray 82 is in the guide position, a holding surface 30 on which the sheet 12 is placed defines a part of the common path 65. The manual feed tray 82 in the guide position guides insertion of the sheet 12 placed on the holding surface 30 into the common path 65. The manual feed tray 82 in the non-guide position is retracted downward from the guide position such that the holding surface 30 is parallel with a rear surface of the lower guide member 83. The position of the manual feed tray 82 may be changed by a user by holding and pivoting the manual feed tray 82.

Figure 5:
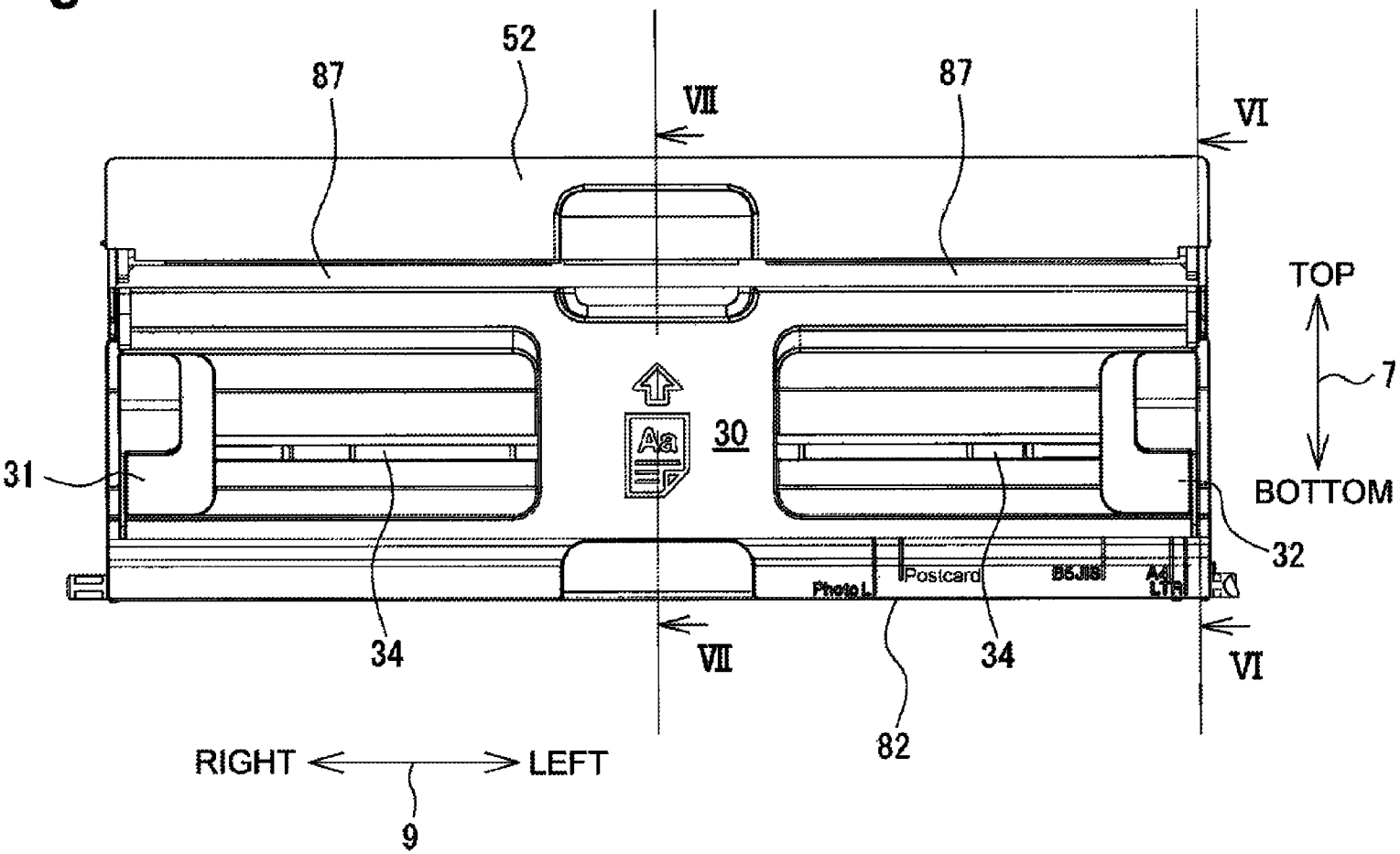
FIG. 5 is a back view of the upper guide member and the manual feed tray of the printing unit of FIG. 3.

As shown in FIGS. 1A, 2, and 5, opposite side guides 31, 32 are disposed on the holding surface 30 of the manual feed tray 82. The side guides 31, 32 are configured to contact opposite edges in a widthwise direction (right-left direction 9) of the sheet 12 placed on the holding surface 30 and to position the sheet 12 in a widthwise direction of the manual feed tray 82. The side guides 31, 32 are supported on the holding surface 30 so as to slide along grooves 34 in the right-left direction 9. The sheet 12 is held on a portion sandwiched between the side guides 31, 32. The side guides 31, 32 may be linked by a rack and pinion mechanism such that when one of the side guides 31, 32 is slid in one direction, the other slides in a direction opposite to the one direction. This structure allows the manual feed tray 82 to hold sheets 12 of various sizes on the holding surface 30.

As shown in FIG. 3, a stopper 90 is disposed between the first roller pair 58 and the rear end 55, along the common path 65.

Figure 8:
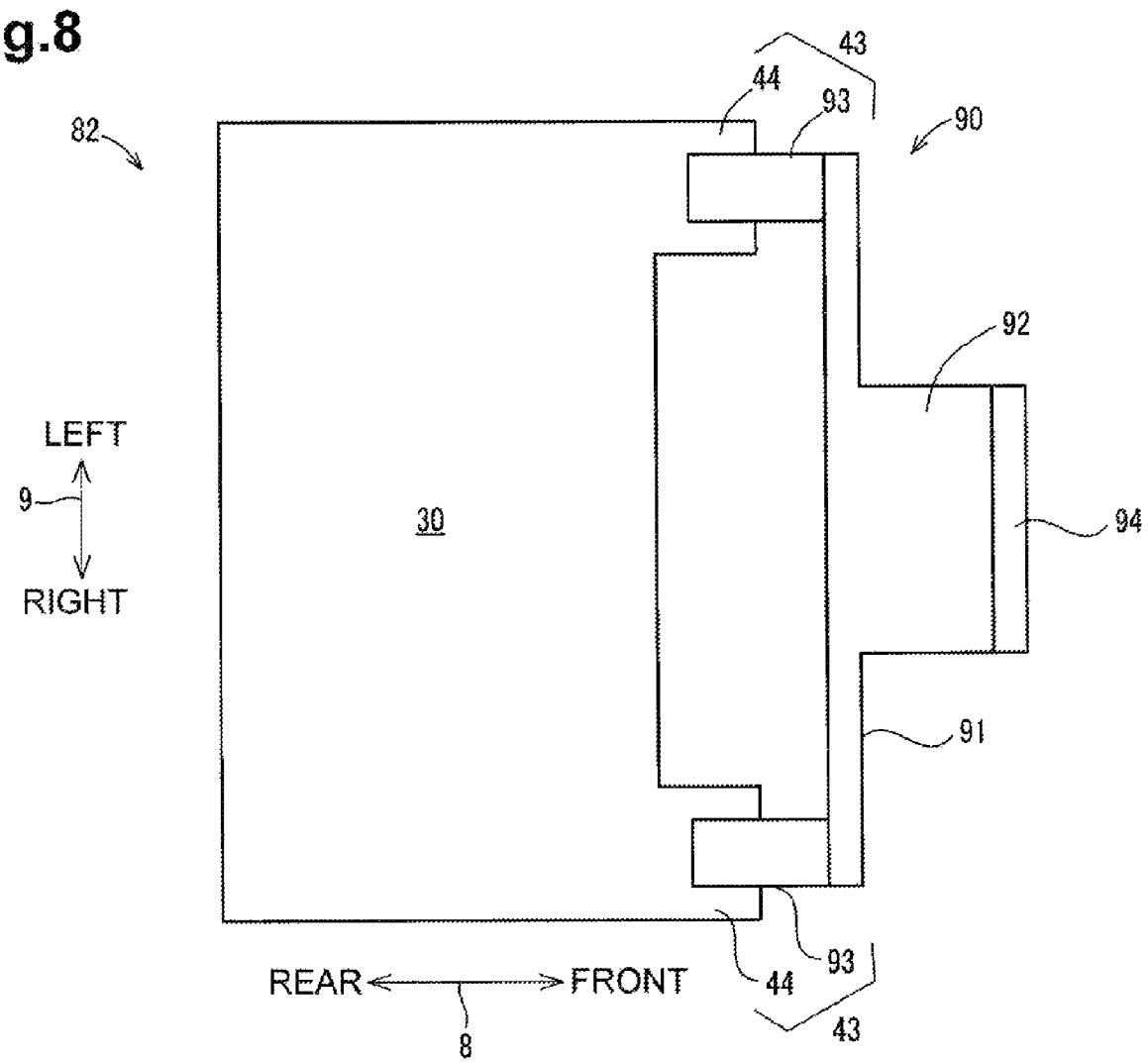
FIG. 8 is a schematic plan view of the manual feed tray in the first tray position and the stopper of the printing unit of FIG. 3.

As shown in FIG. 8, the stopper 9 comprises a second pivot shaft, e.g., a shaft 91, a first protrusion 92 that protrudes from a central portion in a longitudinal direction (in the right-left direction 9) of the shaft 91, and second protrusions 93 that protrude from end portions in the longitudinal direction of the shaft 91. The second protrusions 93 protrude in a direction substantially opposite to a protruding direction of the first protrusion 92.

The second protrusions 93 has a generally rod shape. The first protrusion 92 has a greater width in the right-left direction than the second protrusion 93 and comprises a contact portion, e.g., an end portion 94, which is bent upward as shown in FIGS. 6A through 7B.

As shown in FIGS. 6A through 7B, the shaft 91 is rotatably supported by the upper guide member 52. In this state, the first protrusion 92 protrudes frontward, the second protrusions 93 protrude rearward, and the end portion 94 of the first protrusion 92 is bent upward. The first protrusion 92 is disposed in a passing zone of the media tray 71 with respect to the right-left direction 9 perpendicular to a conveying direction of the media tray 71 (front-rear direction 8). The second protrusions 92 are disposed outside the passing zone of the media tray 71 with respect to the right-left direction 9.

Figure 6B:
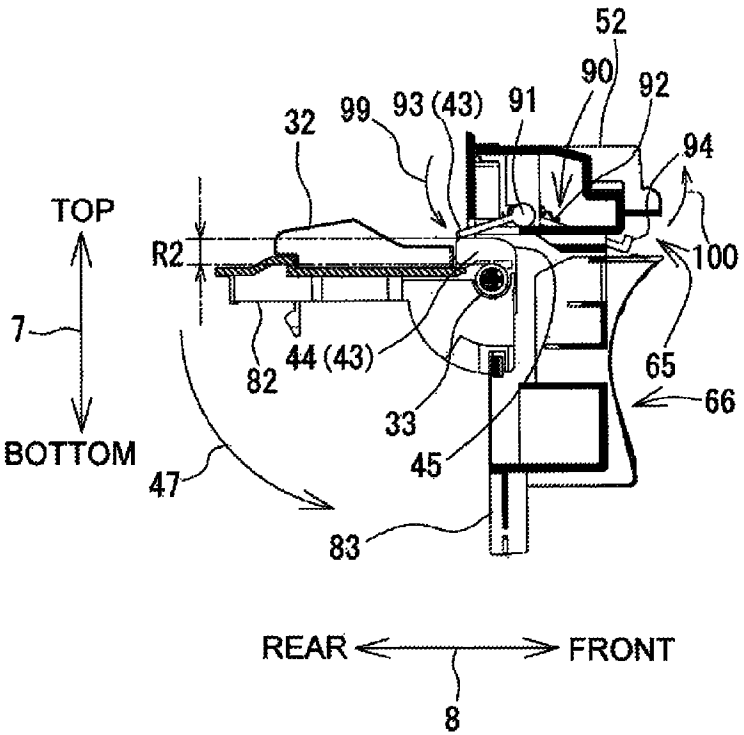
FIG. 6B is a cross-sectional view of the upper guide member and the manual feed tray taken along line VI-VI of FIG. 5 when the manual feed tray is in the guide position.
Figure 6A:
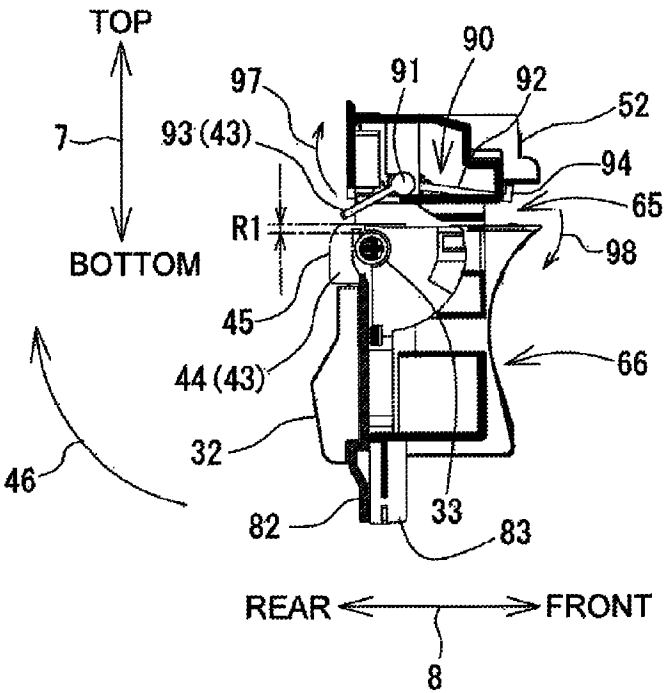
FIG. 6A is a cross-sectional view of the upper guide member and the manual feed tray taken along line VI-VI of FIG. 5 when the manual feed tray is in the non-guide position.
Figure 7B:
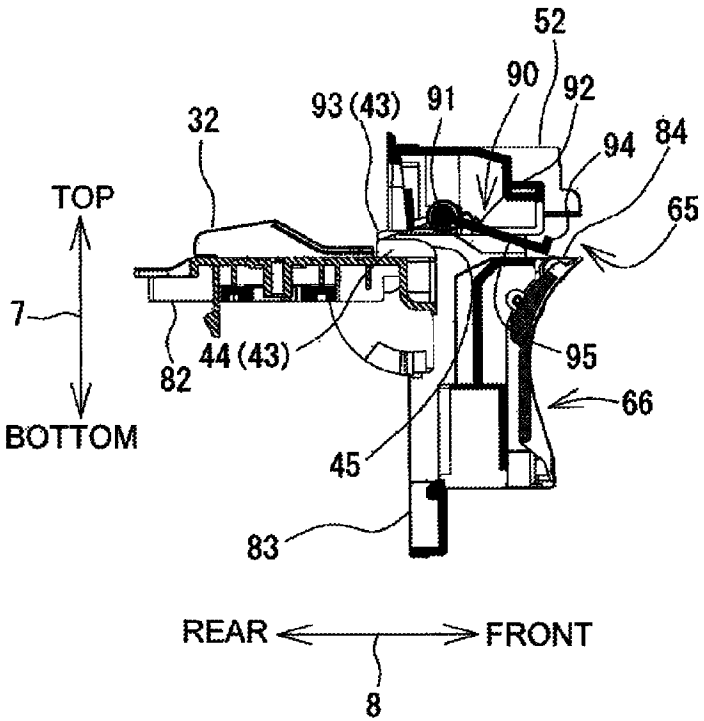
FIG. 7B is a cross-sectional view of the upper guide member and the manual feed tray taken along line VII-VII of FIG. 5 when the manual feed tray is in the guide position.
Figure 7A:
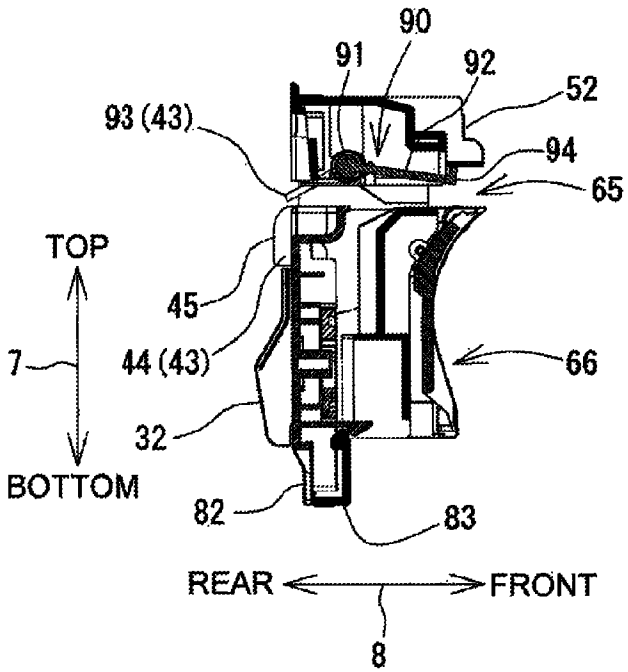
FIG. 7A is a cross-sectional view of the upper guide member and the manual feed tray taken along line VII-VII of FIG. 5 when the manual feed tray is in the non-guide position.

As shown in FIG. 3, the stopper 90 is configured to pivot about the shaft 91 in directions shown by arrows 80 between a protruding position shown in FIGS. 6B and 7B and a retracted position shown in FIGS. 6A and 7A.

In one embodiment, the stopper 90 may be configured such that the second protrusions 93 have a greater weight than the first protrusion 92. In another embodiment, the stopper 90 may be configured to be urged into the retracted position by an urging member (not shown), e.g., a coil spring.

As shown in FIGS. 6B and 7B, when the stopper 90 is in the protruding position, the first protrusion 92 protrudes downward into the common path 65. The protruding dimension of the stopper 90 into the common path 65 is less than a height of the common path in the top-bottom direction 7. The top-bottom direction 7 is perpendicular to the front-rear direction 8 along which the sheet 12 or the media tray 71 is conveyed. The stopper 90 does not block the common path 65 completely. Specifically, as shown in FIG. 11A, there is a clearance A between a corner of a lower surface 95 of the first protrusion 92 and an upper surface 84 of the lower guide member 83 that defines a part of the common path 65 from below. The upper surface 84 is an example of a first guide surface. The clearance A is less than a thickness B of the media tray 71. As shown in FIG. 11A, an end of the media tray 71 conveyed along the common path 65 in the direction shown by arrow 77 abuts against the front surface of the end portion 94, thereby to stop conveyance of the media tray 71.

Figure 11B:
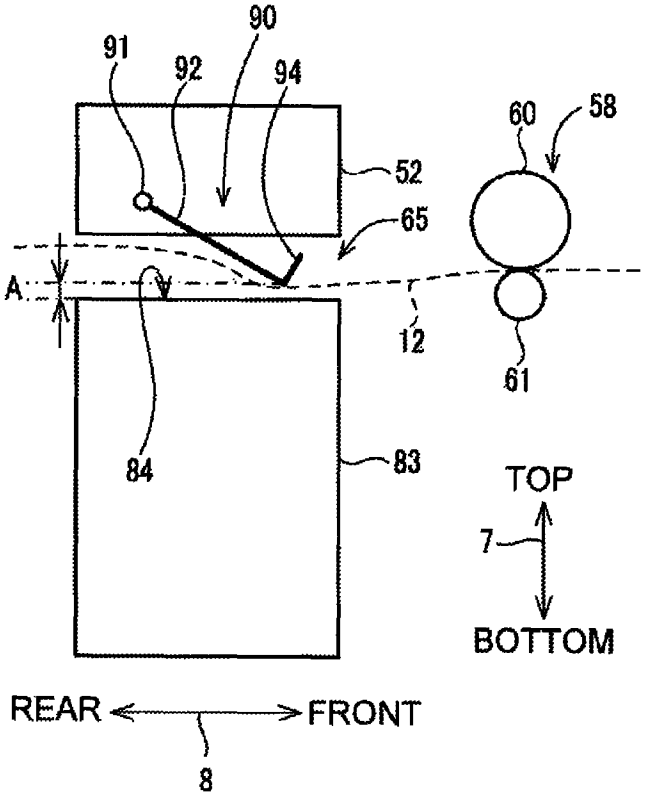
FIG. 11B is a schematic vertical cross-sectional view of the upper guide member, the lower guide member, the stopper, and the first roller pair of the printing unit of FIG. 3, showing a state in which a sheet is inserted.
Figure 11A:
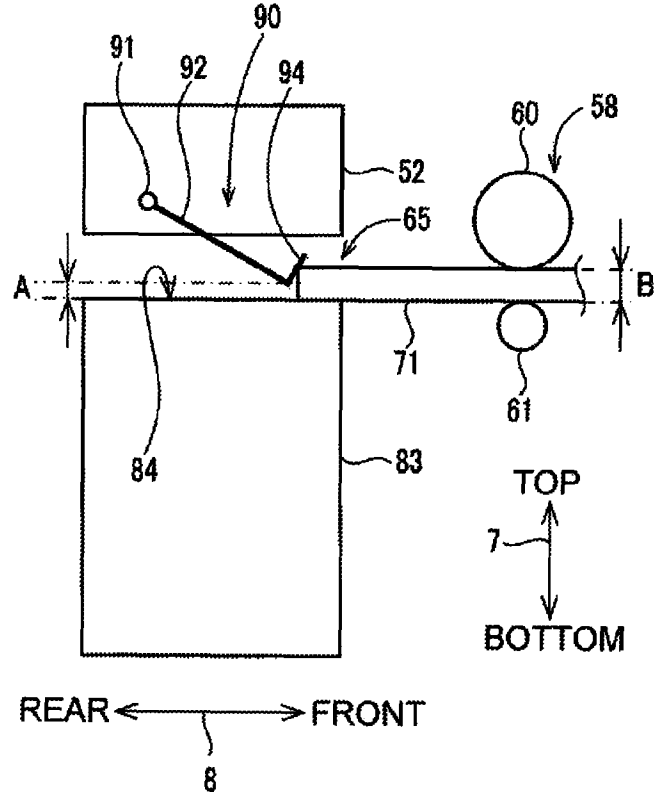
FIG. 11A is a schematic vertical cross-sectional view of the upper guide member, the lower guide member, the stopper, and a first roller pair of the printing unit of FIG. 3, showing a state in which a media tray is inserted.

In short, as shown in FIG. 11B, the stopper 90 in the protruding position protrudes downward into the common path, toward a recording surface of the sheet 12 to be conveyed along the common path 65 and stops conveyance of the media tray 71.

As shown in FIG. 7B, when the stopper 90 is in the protruding position, the lower surface 95 of the first protrusion 92, which is a surface defining a part of the common path 65, is inclined downward from the rear to the front. The lower surface 95 is an example of a second guide surface.

As shown in FIG. 11B, the clearance A is greater than the thickness of the sheet 12 or, more specifically, than the maximum thickness of a recording medium insertable from the manual feed tray 82 into the common path 65. Thus, as shown in FIG. 7B, the sheet 12 inserted from the manual feed tray 82 in the direction of arrow 78 is guided by the lower surface 95 of the first protrusion 92 into the clearance A and passes through the clearance A. Then the sheet 12 is pinched by the first roller pair 58 and is conveyed in the direction of arrow 78.

In short, the stopper 90 in the protruding position allows conveyance of the sheet 12 while stopping conveyance of the media tray 71.

As shown in FIG. 7A and by broken lines in FIG. 3, when the stopper 90 is in the retracted position, the first protrusion 92 is retracted upward from the common path 65. In other words, when the stopper 90 is in the retracted position, the first protrusion 92 is retracted into the upper guide member 52 and the upper guide member 52 defines a part of the common path 65 from above. The stopper 90 in the retracted position allows conveyance of the media tray 71 along the common path 65 without stopping the media tray 71. In other embodiments, when the stopper 90 is in the retracted position, the stopper 90 may not be retracted completely into the upper guide member 52 and a part of the stopper 90 may protrude into the common path 65 as long as the stopper 90 allows conveyance of the media tray 71.

The printer 11 comprises a moving unit 43 configured to move the stopper 90 between the retracted position and the protruding position in response to movement of the manual feed tray 82 between the non-guide position and the guide position. As shown in FIGS. 6A through 8, the moving unit 43 comprises the second protrusions 93 of the stopper 90 and rotary cams 44 disposed at opposite ends of the shaft 33 in the right-left direction 9.

As shown in FIG. 8, the second protrusions 93 and the respective rotary cams 44 are disposed in substantially the same positions in the right-left direction 9 such that the second protrusions 93 are opposite to the respective rotary cams 44.

As shown in FIGS. 6A and 6B, a dimension between the shaft 33 and a circumferential surface 45 of the rotary cam 44 is not constant and varies. Specifically, as shown in FIG. 6A, when the manual feed tray 82 is in the non-guide position, a dimension in the top-bottom direction 7 between the shaft 33 and the circumferential surface 45 of the rotary cam 44 is R1. As shown in FIG. 6B, when the manual feed tray 82 is in the guide position, a dimension in the top-bottom direction 7 between the shaft 33 and the circumferential surface 45 of the rotary cam 44 is R2 which is greater than R1.

As shown in FIGS. 6A and 7A, when the manual feed tray 82 is pivoted about the shaft 33 in a direction shown by arrow 46 from a state in which the manual feed tray 82 is in the non-guide position and the stopper 90 is in the retracted position, the manual feed tray 82 moves from the non-guide position to the guide position. As the manual feed tray 82 moves in this way, the distance in the top-bottom direction between the shaft 33 and the circumferential surface 45 of the rotary cam 44 increases gradually from R1 to R2. Consequently, the circumferential surface 45 of the rotary cam 44 contacts and pushes the second protrusion 93. The stopper 90, in turn, pivots in a first pivoting direction, e.g., a direction shown by arrow 97, against an urging force that urges the stopper 90 toward the retracted position. In this way, the second protrusion 93 is guided by the circumferential surface 45 of the rotary cam 44. At this time, the shaft 91 rotates.

When the shaft 91 rotates, the first protrusion 92 protruding from the shaft 91 pivots in a direction shown by arrow 98. As shown in FIGS. 6B and 7B, the first protrusion 92 pivots to a position for stopping conveyance of the media tray 71. The stopper 90 moves to the protruding position. In this way, the moving unit 43 causes the stopper 90 to move from the retracted position to the protruding position in response to movement of the manual feed tray 82 from the non-guide position to the guide position.

As shown in FIGS. 6B and 7B, when the manual feed tray 82 is pivoted about the shaft 33 in a direction shown by arrow 47 from a state in which the manual feed tray 82 is in the guide position and the stopper 90 is in the protruding position, the manual feed tray 82 moves from the guide position to the non-guide position. As the manual feed tray 82 moves in this way, the distance in the top-bottom direction between the shaft 33 and the circumferential surface 45 of the rotary cam 44 decreases gradually from R2 to R1. Consequently, the second protrusion 93 is urged by the urging force toward the retracted position and pivots in a second pivoting direction, e.g., a direction shown by arrow 99. In this way, the second protrusion 93 is guided by the circumferential surface 45 of the rotary cam 44. At this time, the shaft 91 rotates.

When the shaft 91 rotates, the first protrusion 92 protruding from the shaft 91 pivots in a direction shown by arrow 100. As shown in FIGS. 6A and 7A, the first protrusion 92 pivots to a position for allowing conveyance of the media tray 71 and the stopper 90 moves to the retracted position. In this way, the moving unit 43 causes the stopper 90 to move from the protruding position to the retracted position in response to movement of the manual feed tray 82 from the guide position to the non-guide position.

As shown in FIGS. 6A and 6B, the shaft 33 of the manual fed tray 82 and the shaft 91 of the stopper 90 are positioned on opposite sides of the common path 65.

As shown in FIG. 3, the printer 11 comprises a sheet sensor 120 for sensing presence or absence of the sheet 12 or the media tray 71 conveyed along the common path 65 in the direction shown by arrow 77 or in the direction shown by arrow 78. The sheet sensor 120 is disposed between the stopper 90 and the first roller pair 58, along the common path 65. The sheet sensor 120 is disposed closer to the front end portion 54 than the stopper 90.

The sheet sensor 120 may comprise a rotating body 121 configured to rotate about a shaft 123, and a photosensor 122 (e.g., a photointerrupter) including a light receiving element (e.g., a phototransistor) that receives light emitted from a light emitting element (e.g., a light emitting diode). The shaft 123 of the rotating body 121 may be rotatably attached to a frame of the MFD 10, e.g., the inner guide member 19. One end of the rotating body 121 protrudes into the common path 65.

As shown in FIG. 3, when the media tray 71 or the sheet 12 is out of contact with the rotating body 121, the other end of the rotating body 121 is in an optical path extending between the light emitting element and the light receiving element of the photosensor 122 and blocks light passing through the optical path. When a leading edge of the media tray 71 or the sheet 12 contacts and pushes the rotating body 121, the other end of the rotating body 121 moves away from the optical path to allow light to pass through the optical path. After the media tray 71 or the sheet 12 passes the rotating body 121, the rotating body 121 returns to an original position shown in FIG. 3. At this time, the other end of the rotating body 121 enters the optical path and blocks light passing through the optical path.

The photosensor 122 is connected to a microcomputer 130 (shown in FIG. 9) which will be described later. The photosensor 122 may output a signal at a relatively high level to the microcomputer 130 when light passes through the optical path, and may output a signal at a relatively low level to the microcomputer 130 when light is blocked by the rotating body 121. The microcomputer 130 detects a leading edge of the media tray 71 or the sheet 12, based on the signal input from the photosensor 122. The sheet sensor 120 and the microcomputer 130 are an example of a second detector.

Figure 9:
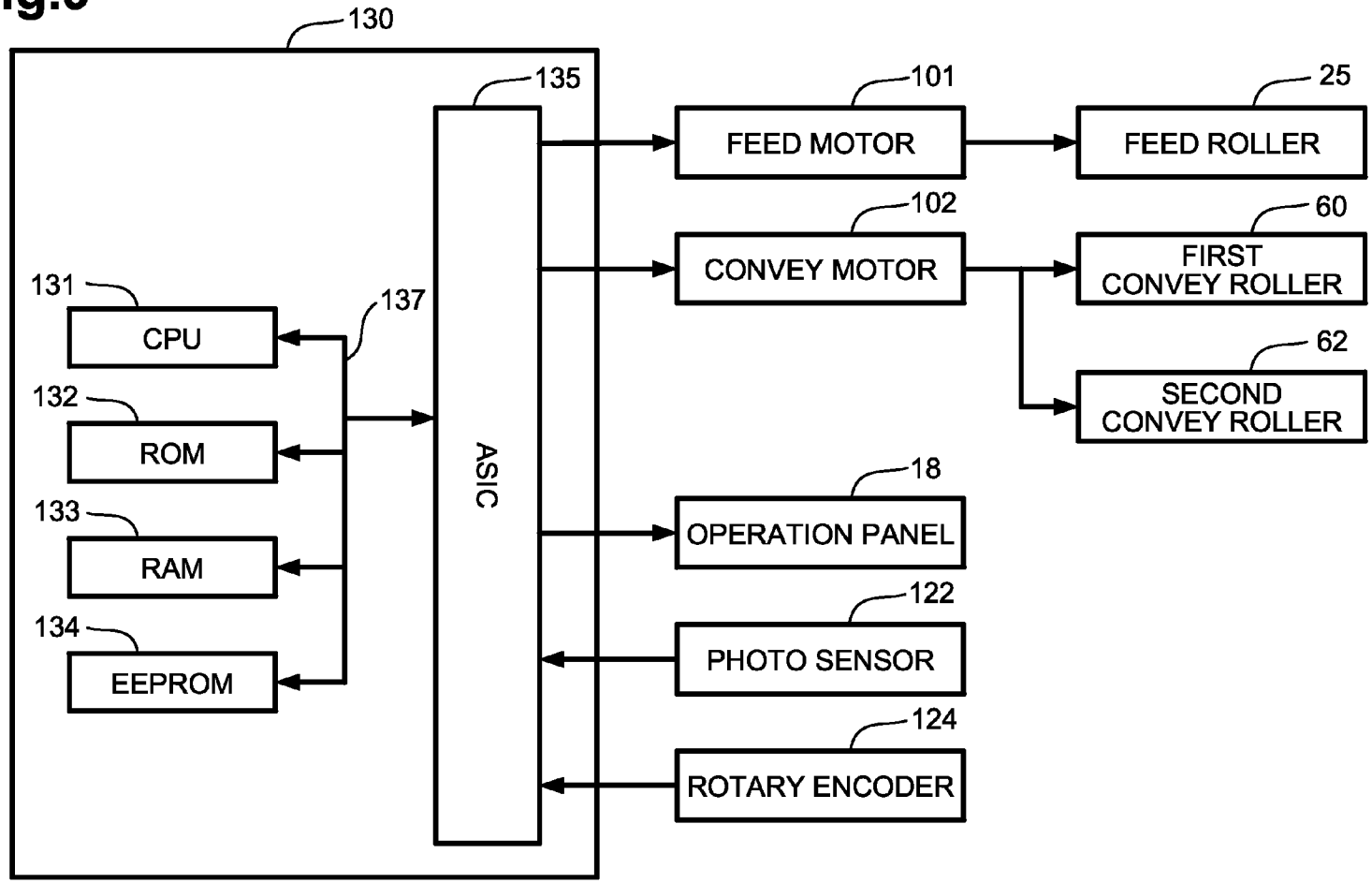
FIG. 9 is a block diagram showing a structure of a microcomputer of the MFD of FIG. 1A.

As shown in FIG. 9, the printer 11 comprises a rotary encoder 124. The rotary encoder 124 is attached to the shaft of the first convey roller 60 and comprises an encoder disk (not shown) rotating integrally with the first convey roller 60 and a photosensor (not shown). The photosensor senses a pattern formed in the encoder disk and outputs signals to the microcomputer 130.

The microcomputer 130 is connected to the photosensor of the rotary encoder 124 and calculates the rotation angle of the first convey roller 60 based on the signals input from the photosensor.

As shown in FIG. 9, the microcomputer 130 controls overall operations of the MFD 10. The microcomputer 130 comprises a central processing unit (CPU) 131, a read only memory (ROM) 132, a random access memory (RAM) 133, an electrically erasable programmable read only memory (EEPROM) 134, and an application specific integrated circuit (ASIC) 135. These components are connected to each other via an internal bus 137.

The ROM 132 stores programs used by the CPU 131 to control various operations. The RAM 133 serves as a temporary storage of data and signals used by the CPU 131 for executing the programs and as a working area used by the CPU 131 for processing data. The EEPROM 134 stores settings and flags to be held even after power-off.

The feed motor 101 and the convey motor 102 are respectively connected to drive circuits provided in the ASIC 135. When the CPU 131 inputs a drive signal for driving a corresponding motor to a corresponding drive circuit, the drive circuit outputs a drive current in accordance with the drive signal to the corresponding motor. Consequently, the corresponding motor rotates in a forward or reverse direction at a predetermined rotation speed.

As described earlier, the photosensor 122 of the sheet sensor 120 is connected to the ASIC 135. The rotary encoder 124 is also connected to the ASIC 135.

An operation panel 18 (shown in FIG. 1B) disposed on an upper surface of a front end portion of the MFD 10 is also connected to the ASIC 135. The microcomputer 130 controls the operation panel 18 to display a predetermined message. The microcomputer 130 and the operation panel 18 are an example of a notifying unit. In this embodiment, the microcomputer 130 controls the operation panel 18 to selectively display one of a first message and a second message. The first message reads "Move the manual feed tray to the non-guide position." The second message reads "Move the device away from the wall." The microcomputer 130 and the operation panel 18 notify the user, by the first message, to move the manual feed tray and, by the second message, to move the MFD 10. In another embodiment, the first message and the second message may be opposite to each other. Control by the microcomputer 130 for displaying the messages on the operation panel 18 will be described later.

Control of the convey motor 102 by the microcomputer 130 will now be described. The microcomputer 130 controls the first convey roller 60 by controlling a current value (or a voltage value) of a drive signal, as described above. Specifically, the microcomputer 130 outputs a drive signal for a predetermined current value to the convey motor 102 such that the first convey roller 60 rotates at a predetermined rotation speed. The microcomputer 130 calculates the rotation angle of the first convey roller 60 based on a signal input from the photosensor of the rotary encoder 124. The microcomputer 130 counts, using a built-in timer circuit or the like, the time taken by the first convey roller 60 to rotate by the calculated rotation angle. The microcomputer 130 calculates the rotation speed of the first convey roller 60 based on the calculated rotation angle and the counted time. When the calculated rotation speed is less than the predetermined rotation speed, the microcomputer 130 increases the current value of the drive signal to be output to the convey motor 102. When the calculated rotation speed is greater than the predetermined rotation speed, the microcomputer 130 decreases the current value of the drive signal to be output to the convey motor 102. Consequently, the rotation speed of the first convey roller 60 is properly controlled.

The microcomputer 130 determines whether or not conveyance of the media tray 71 is stopped, as described below. With the above-described control by the microcomputer 130, when the media tray 71 is stopped by the stopper 90 or the like while being pinched by the first roller pair 58, the first convey roller 60 is prevented from rotating. In this case, the microcomputer 130 increases the current value of the drive signal to be output to the covey motor 102 and compares the increased current value to a predetermined first threshold value. When the increased current value is greater than or equal to the first threshold value, the microcomputer 130 determines that the media tray 71 is stopped. In other words, the microcomputer 130 detects stoppage of the media tray 71 conveyed by the first roller pair 58. The rotary encoder 124 and the microcomputer 130 are an example of a first detector.

Figure 12A:
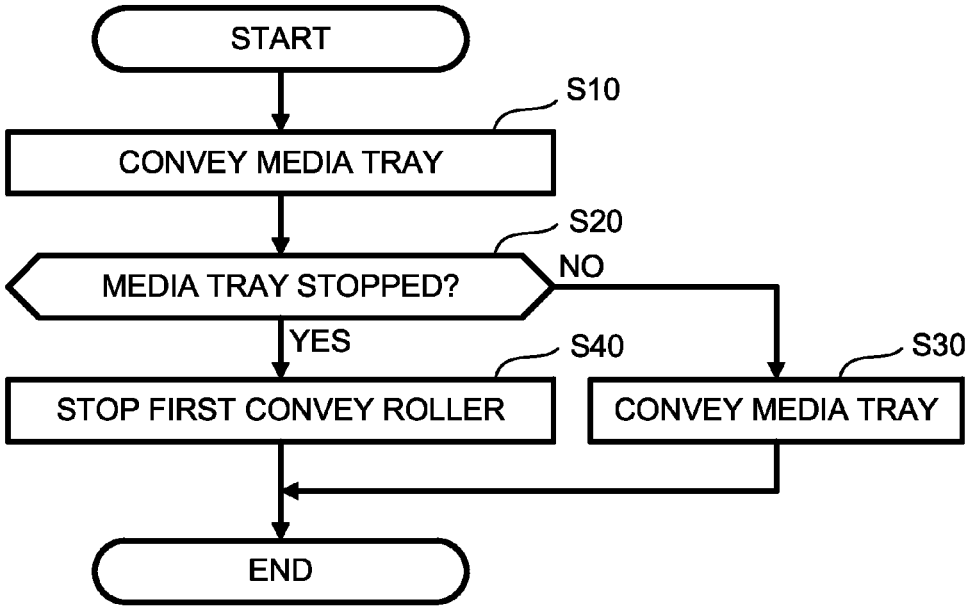
FIG. 12A is a flowchart showing control by the microcomputer of the MFD of FIG. 1A to stop the media tray.

Referring to FIG. 12A, control by the microcomputer 130 for stopping the media tray 71 will be described. The media tray 71 is placed by the user on the tray guide 76 and is inserted from the front end 54 of the MFD 10. Then when the first roller pair 58 and the second roller pair 59 convey the media tray 71 in the direction shown by arrow 77 in step 10 (S10), the microcomputer 130 determines whether or not the media tray 71 is stopped, as described above, in step 20 (S20). When the microcomputer 130 does not detect stoppage of the media tray 71 (S20: No), the microcomputer 130 causes the media tray 71 to be continuously conveyed in step 30 (S30). On the other hand, when the microcomputer 130 detects stoppage of the media tray 71 (S20: Yes), the microcomputer 130 stops outputting the drive signal to the convey motor 102 in step 40 (S40) thereby to stop the first convey roller 60. The microcomputer 130 is an example of a controller.

Figure 12B:
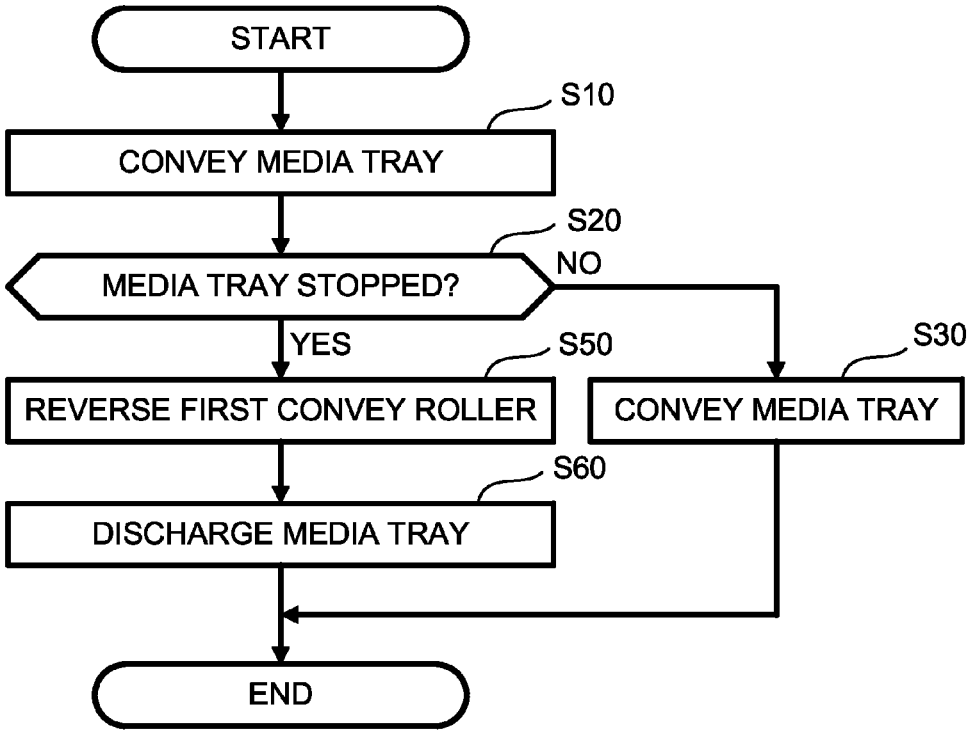
FIG. 12B is a flowchart showing control by the microcomputer to convey the media tray in a reverse direction.

In another embodiment, when the microcomputer 130 detects stoppage of the media tray 71, the microcomputer 130 may control the first convey roller 60 to rotate in a reverse direction instead of controlling the first convey roller 60 to stop rotating. Referring to FIG. 12B, control by the microcomputer 130 of the first convey roller 60 to rotate in the reverse direction will be described. Step 10 (S10) through step 30 (S30) are the same as those in the case shown in FIG. 12A. When the microcomputer 130 detects stoppage of the media tray 71 (S20: Yes), the microcomputer 130 converts the drive signal currently output to the convey motor 102 to a drive signal having a phase difference of 180 degrees from the currently output drive signal. Consequently, the first convey roller 60 rotates in the reverse direction in step 50 (S50). In other words, when the microcomputer 130 detects stoppage of the media tray 71, the microcomputer 130 stops applying a first driving force to the convey motor 102 and applies a second driving force to the convey motor 102. Consequently, the media tray 71 having been conveyed in the direction of arrow 77 is conveyed in a reverse direction shown by arrow 78 and is discharged from the front opening 13 in step 60 (S60).

Figure 13:
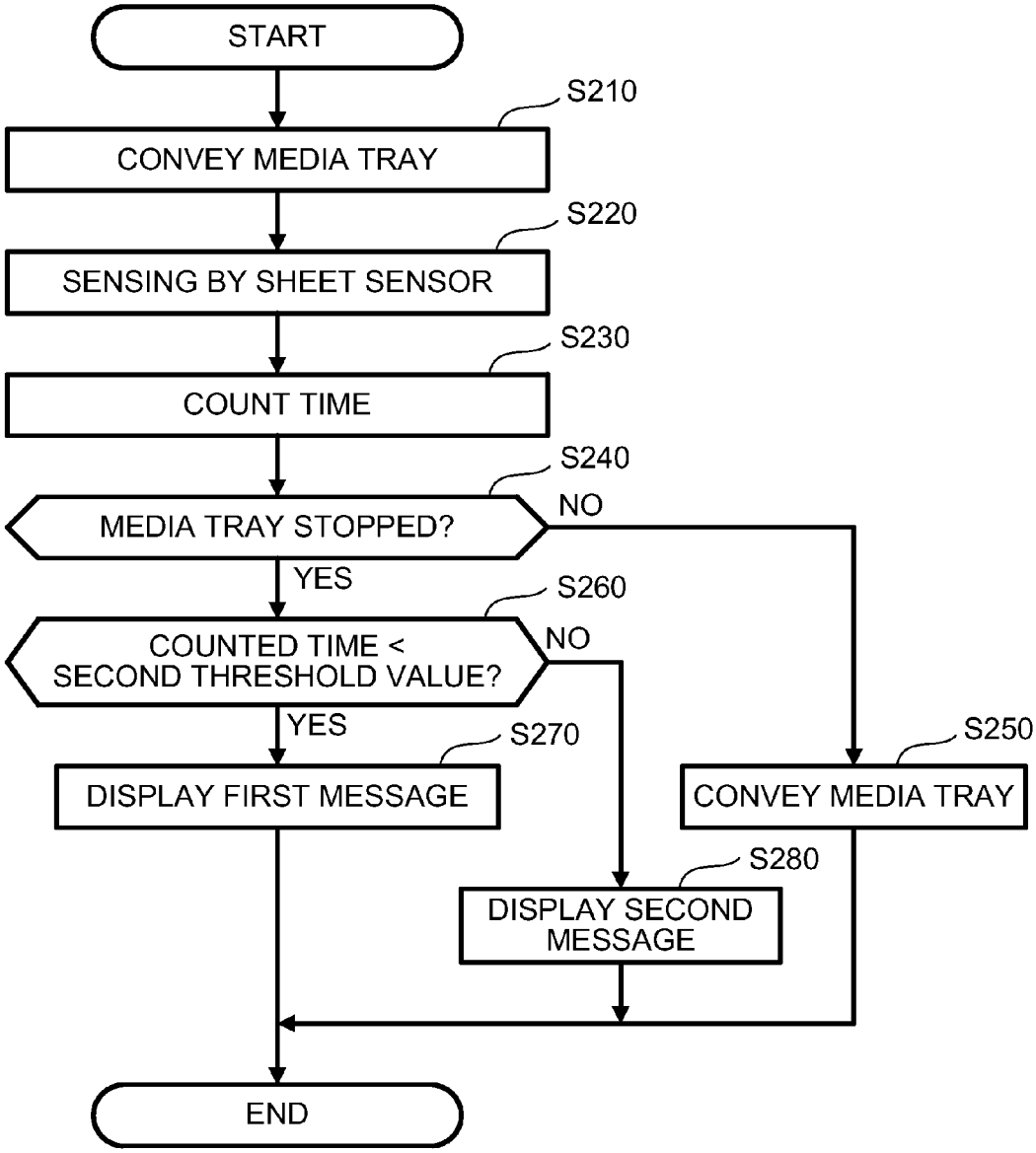
FIG. 13 is a flowchart showing notifying control by the microcomputer.

The microcomputer 130 controls the operation panel 18 to display one of the first message and the second message based on the time when the microcomputer 130 detects, in cooperation of the rotary encoder 124, stoppage of the media tray 71 with reference to the time when the microcomputer 130 detects, in cooperation of the sheet sensor 20, detects a leading edge of the media tray 71. Referring to FIG. 13, control by the microcomputer 130 for issuing notifications, e.g., messages will be described.

Step 210 (S210) is the same as step 10 (S10) shown in FIG. 12A. The sheet sensor 120 senses a leading edge of the media tray 71 conveyed in the direction of arrow 77 in step 220 (S220). In step 230 (S230), the microcomputer 130 counts, using the above-described timer circuit or the like, the time elapsed after detection of the leading edge of the media tray 71 based on the signal input from the photosensor 122 of the sheet sensor 120 until detection of stoppage of the media tray 71 based on the current value of the drive signal and the first threshold value.

The microcomputer 130 determines whether the media tray 71 is stopped in step 240 (S240), in a manner described above. When the microcomputer 130 does not detect stoppage of the media tray 71 in step 240 (S240: No), the microcomputer 130 controls the media tray 71 to be conveyed continuously in step 250 (S250). On the other hand, when the microcomputer 130 detects stoppage of the media tray 71 in step 240 (S240: Yes), the microcomputer 130 determines whether the counted time is less than a predetermined second threshold value in step 260 (S260).

When the microcomputer 30 determines that the counted time is less than the second threshold value in step 260 (S260: Yes), the microcomputer 130 determines that the media tray 71 has collided with the stopper 90 positioned in the protruding position. In this case, the microcomputer 130 controls the operation panel 18 to display the first message "Move the manual feed tray to the non-guide position" in step 270 (S270). When the user moves the manual feed tray 82 to the non-guide position by following the message, the moving unit 43 moves the stopper 90 to the retracted position. Consequently, the media tray 71 having collided with the stopper 90 starts to be conveyed again.

On the other hand, when the microcomputer 130 determines that the counted time is not less than the second threshold value in step 260 (S260: No), the microcomputer 130 determines that the media tray 71 has protruded from the rear opening 87 and collided with a wall of the room in which the MFD is mounted. In this case, the microcomputer 130 controls the operation panel 18 to display the second message "Move the device away from the wall" in step 280 (S280).

In this embodiment, when the manual feed tray 82 is moved to the guide position for guiding insertion of the sheet 12, the moving unit 43 moves the stopper 90 to the protruding position for stopping conveyance of the media tray 71. Thus, when the media tray 71 is inserted into the common path 65, the stopper 90 stops the media tray 71 and prevents the media tray 71 from colliding with the manual feed tray, e.g., the side guides 31, 32 of the manual feed tray 82.

In this case, the distance between the stopper 90 in the protruding position and the upper surface 84 of the lower guide member 83 is greater than the thickness of the sheet 12. This allows the sheet 12 inserted from the rear end 55 to be conveyed along the common path 65 without being stopped by the stopper 90.

In the above-described embodiment, the stopper 90 protrudes toward the recording surface of the sheet 12 and pushes the sheet 12 against the platen 42, which defines a part of the common path 65 from an opposite side of the recording unit 24. This prevents the sheet 12 from floating in the space of the common path 65 and ensures a high quality image to be recorded on the sheet 12 by the recording unit 24.

In the above-described embodiment, when the stopper 90 is in the protruding position, the end portion 94 of the first protrusion 92 prevents conveyance of the media tray 71, but the lower surface 95 of the first protrusion 92 guides the sheet 12 smoothly along the common path 65.

In the above-described embodiment, when the media tray 71 is conveyed, the eccentric cam 140 and the platen support 53 shift the first roller pair 58 into the second state. At this time, a protruding end of the first protrusion 92 of the stopper 90 is positioned between the first convey roller 60 and the pinch roller in the top-bottom direction 7. Thus, the stopper 90 prevents conveyance of the media tray 71. When the sheet 12 is conveyed, the eccentric cam 140 and the platen support 53 shift the first roller pair into the first state (contact state). At this time, the protruding end of the first protrusion 92 of the stopper 90 is closer to a base end of the first protrusion 92 in the top-bottom direction 7 than a nip position between the first convey roller 60 and the pinch roller 61. Thus, the sheet 12 is guided by the stopper 90 and is directed smoothly to the nip position.

In the above-described embodiment, when the stopper 90 stops the media tray 71, the microcomputer 130 controls the convey motor 102 to stop applying the driving force to the first convey roller 60. This prevents breakage of the media tray 71 and reduces extra power consumption.

Further in the above-described embodiment, when the stopper 90 stops the media tray 71, the media tray 71 may be conveyed in a reverse direction such that the media tray 71 is discharged outward from the front opening 13 of the MFD 10.

Further, in the above-described embodiment, when the rotary encoder 124 and the microcomputer 130 detect stoppage of the media tray 71 within a predetermined period of time after the sheet sensor 120 and the microcomputer 130 detect the leading edge of the media tray 71, the microcomputer 130 determines that the media tray 71 is sopped by the stopper 90. On the other hand, when the rotary encoder 124 and the microcomputer 130 detect stoppage of the media tray 71 after the predetermined period of time after the sheet sensor 120 and the microcomputer 130 detect the leading edge of the media tray 71, the microcomputer 130 determines that the media tray 71 protrudes through the rear opening 87 of the MFD 10 and is stopped by a wall of the room in which the MFD 10 is mounted.

According to one of these cases, the microcomputer 130 controls the operation panel 10 to display a corresponding one of the different messages. This allows the user to take an appropriate action based on the message displayed on the operation panel 18.

Although, in the above-described embodiment, the stopper 90 in the protruding position protrudes downward into the common path 65 to prevent conveyance of the media tray 71, the stopper 90 may protrude upward into the common path 65 to prevent conveyance of the media tray 71.

Figure 10B:
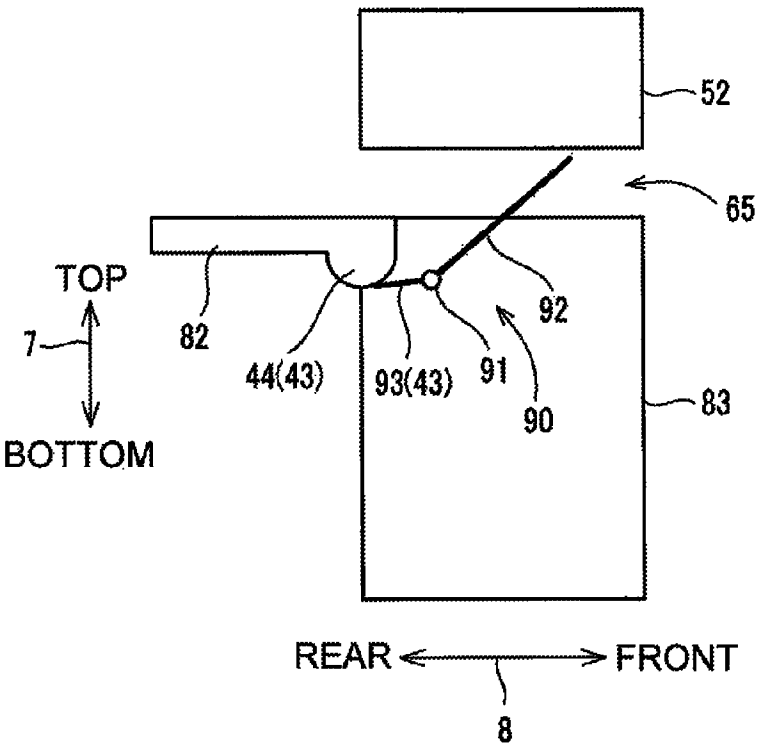
FIG. 10B is a schematic vertical cross-sectional view of the upper guide member, the lower guide member, the manual feed tray, and the stopper of FIG. 10A, showing a state in which the manual feed tray is in a guide position.
Figure 10A:
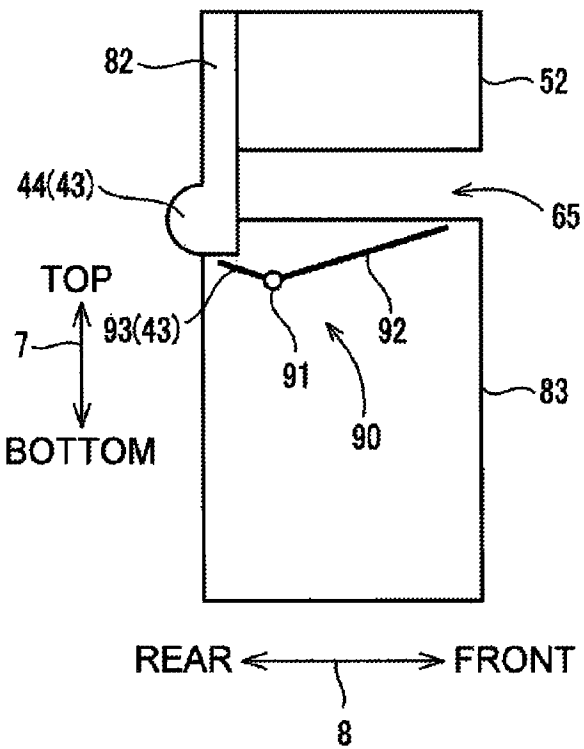
FIG. 10A is a schematic vertical cross-sectional view of an upper guide member, a lower guide member, a manual feed tray, and a stopper according to another embodiment of the present invention, showing a state in which the manual feed tray is in a non-guide position.

In this case, as shown in FIGS. 10A and 10B, the manual feed tray 82 and the stopper 90 may be arranged differently from those in the embodiment depicted in FIGS. 11A and 11B. As shown in FIG. 10A, the manual feed tray 82 in the non-guide position may be retracted upward from the guide position (shown in FIG. 10B) so as to extend in the top-bottom direction 7 along the upper guide member 52 and the lower guide member 83. The shaft 91 of the stopper 90 may be rotatably supported by the lower guide member 83. As the manual feed tray 82 pivots from the non-guide position to the guide position, the circumferential surface of the rotary cam 44 may push down the second protrusion 93 such that the first protrusion 92 protrudes upward into the common path 65.

Figure 14B:
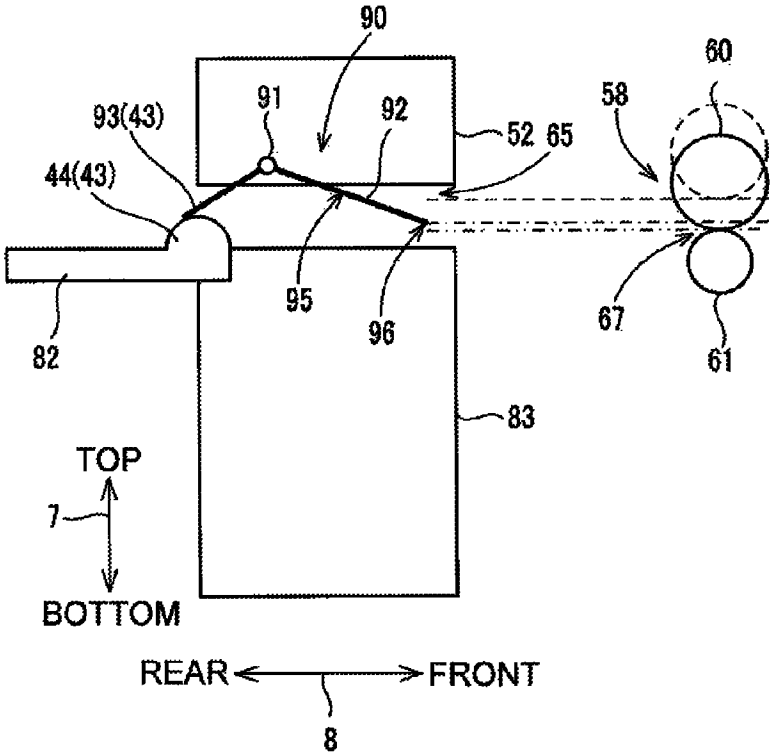
FIG. 14B is a schematic vertical cross-sectional view of an upper guide member, a lower guide member, a manual feed tray, a stopper, and a first roller pair, according to another embodiment of the invention.
Figure 14A:
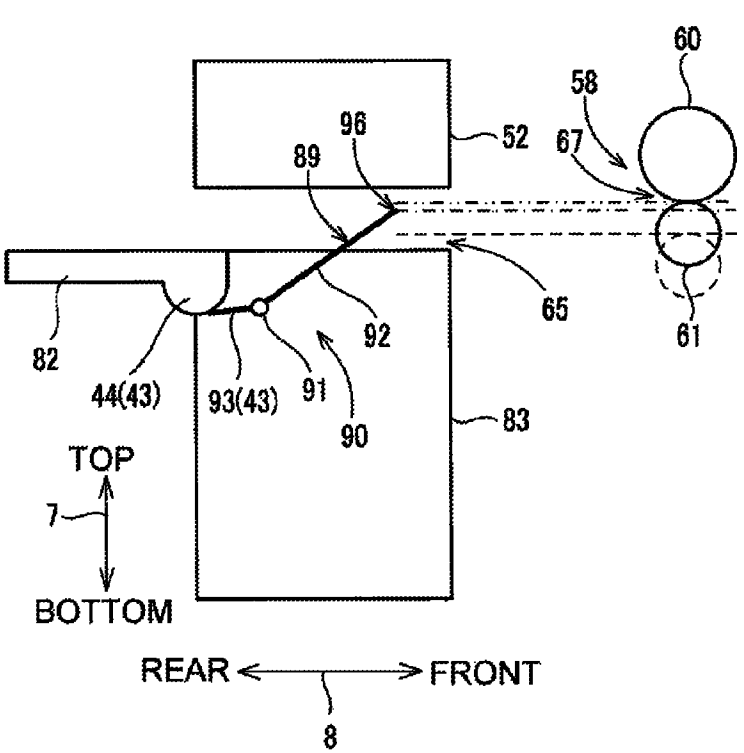
FIG. 14A is a schematic vertical cross-sectional view of an upper guide member, a lower guide member, a manual feed tray, a stopper, and a first roller pair, according to another embodiment of the invention.

As shown in FIGS. 14A and 14B, when the stopper 90 is in the protruding position, a protruding end 96 of the first protrusion 92 is preferably positioned as described below in the top-bottom direction 7.

As shown in FIG. 14A, when the stopper 90 protrudes upward into the common path 65, the height (shown by a one-dot-one-dash line in FIG. 14A) of the protruding end 96 of the first protrusion 92 is lower than the height (shown by a two-dot-one-dash line in FIG. 14A) of a nip position 67 between the first convey roller 60 and the pinch roller 61. In other words, the protruding end 96 is closer to the base end of the first protrusion 92 than the nip position 67 in the top-bottom direction 7. The top-bottom direction 7 is perpendicular to the front-rear direction 8 along which the sheet 12 or the media tray 71 is conveyed. Consequently, the sheet 12 guided by an upper surface 89 of the first protrusion 92 is directed smoothly to the nip position 67.

In the case shown in FIG. 14A, the first roller pair 58 shifts from the first state (contact state) to the second state (spaced state) when the pinch roller 61 moves down. When the first roller pair 58 is in the second state, the height (shown by a one-dot-one-dash line in FIG. 14A) of the protruding end 96 of the first protrusion 92 is lower than the first convey roller 60 (shown by a two-dot-one-dash line in FIG. 14A) and higher than the pinch roller 61 (shown by a broken line in FIG. 14A). Consequently, the media tray 71 conveyed in the direction of arrow 77 while being pinched by the first roller pair 58 comes into contact with the stopper 90 which, in turn, prevents further rearward conveyance of the media tray 71.

As shown in FIG. 14B, when the stopper 90 protrudes downward into the common path 65, the height (shown by a one-dot-one-dash line in FIG. 14B) of a protruding end 96 of the first protrusion 92 is higher than the height (shown by a two-dot-one-dash line) of the nip position 67 between the first convey roller 60 and the pinch roller 61 of the first convey roller pair 58 in the first state. In other words, the protruding end 96 of the first protrusion 92 is positioned closer to the base end of the first protrusion 92 than the nip position 67 in the top-bottom direction 7. The top-bottom position 7 is perpendicular to the front-rear direction 8 along which the sheet 12 or the media tray 71 is conveyed. Consequently, the sheet guided by a lower surface 95 of the first protrusion 92 is directed smoothly to the nip position 67.

In the case shown in FIG. 14B, the first roller pair 58 sifts from the first state (contact state) to the second state (spaced state) when the first convey roller 60 moves up. When the first roller pair 58 is in the second state, the height (shown by a one-dot-one-dash line in FIG. 14B) of the protruding end 96 of the first protrusion 92 is lower than the first convey roller 60 (shown by a two-dot-one-dash line in FIG. 14B) and higher than the pinch roller 61 (shown by a broken line in FIG. 14A). Consequently, the media tray 71 conveyed in the direction of arrow 77 while being pinched by the first roller pair 58 comes into contact with the stopper 90 which, in turn, prevents further rearward conveyance of the media tray 71.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. An image recording device comprising:

a tray configured to hold a first recording medium;

an insertion guide configured to move between a guide position for guiding insertion of a second recording medium into a common path, and a non-guide position retracted from the guide position;

a conveyer configured to convey the tray toward the insertion guide along the common path in a first direction, and to convey the second recording medium from the insertion guide along the common path in a second direction opposite to the first direction;

a recording unit disposed along the common path and configured to record an image selectively on the first recording medium held by the tray and the second recording medium;

a stopper disposed between the recording unit and the insertion guide and configured to move between a protruding position in which the stopper protrudes into the common path and a retracted position in which the stopper is retracted from the protruding position; and a moving unit configured to move the stopper in response to movement of the insertion guide such that:

when the insertion guide moves from the non-guide position to the guide position, the stopper disposed between the recording unit and the insertion guide moves from the retracted position to the protruding position in which the stopper stops conveyance of the tray toward the insertion guide in the first direction and allows conveyance of the second recording medium from the insertion guide in the second direction, and when the insertion guide moves from the guide position to the non-guide position, the stopper moves from the protruding position to the retracted position in which the stopper allows conveyance of the tray toward the insertion guide in the first direction.

2. The image recording device according to claim 1, further comprising a first guide surface defining a part of the common path and positioned opposite to the stopper such that the first guide surface and the stopper in the protruding position provide a clearance therebetween which is greater than a thickness of the second recording medium.

3. The image recording device according to claim 1, wherein when the stopper is in the protruding position, the stopper protrudes into the common path in a height direction of the common path by a predetermined distance which is less than a height of the common path, the height direction being a direction perpendicular to the first direction, and wherein when the stopper is in the retracted position, the stopper is retracted from the common path.

4. The image recording device according to claim 1, wherein the stopper comprises a second guide surface defining a part of the common path and configured to guide the second recording medium inserted into the common path.

5. The image recording device according to claim 1, wherein the stopper is configured to protrude into the common path toward a recording surface of the second recording medium to be conveyed along the common path.

6. The image recording device according to claim 1, wherein the insertion guide comprises a contact portion configured to contact the stopper and to move the stopper between the retracted position and the protruding position in response to movement of the insertion guide between the non-guide position and the guide position, respectively.

7. The image recording device according to claim 1, wherein the insertion guide comprises a first pivot shaft and is configured to pivot about the first pivot shaft between the guide position and the non-guide position, and wherein the stopper comprises a second pivot shaft and a first protrusion protruding from the second pivot shaft, and is configured to pivot about the second pivot shaft between the protruding position and the retracted position.

8. The image recording device according to claim 7, wherein the moving unit comprises:

a rotary cam disposed on the first pivot shaft of the insertion guide and having a circumferential surface, wherein a dimension between the first pivot shaft and the circumferential surface varies; and a second protrusion protruding from the second pivot shaft of the stopper to a position opposite to the rotary cam, wherein the second protrusion of the moving unit is guided by the circumferential surface of the rotary cam to pivot in a first pivoting direction when the insertion guide pivots from the non-guide position to the guide position, and wherein the first protrusion of the stopper pivots to a position for stopping conveyance of the tray when the second pivot shaft of the stopper rotates in response to pivoting of the second protrusion of the moving unit in the first pivoting direction.

9. The image recording device according to claim 8, wherein the second protrusion of the moving unit is guided by the circumferential surface of the rotary cam to pivot in a second pivoting direction opposite to the first pivoting direction when the insertion guide pivots from the guide position to the non-guide position, and wherein the first protrusion of the stopper pivots to a position for allowing conveyance of the tray when the second pivot shaft of the stopper rotates in response to pivoting of the second protrusion of the moving unit in the second pivoting direction.

10. The image recording device according to claim 7, wherein the first pivot shaft of the insertion guide and the second pivot shaft of the stopper are positioned on opposite sides of the common path.

11. The image recording device according to claim 1, wherein the stopper comprises:

a contact portion configured to contact an end of the tray conveyed in the first direction when the stopper is in the protruding position; and a second guide surface configured to guide the second recording medium inserted along the insertion guide in the second direction when the stopper is in the protruding position.

12. The image recording device according to claim 1, wherein the conveyor comprises a first roller and a second roller, and the image recording device further comprises a shifter configured to shift the conveyor between a first state in which the first roller and the second roller are in contact with each other at a nip position, and a second state in which the first roller and the second roller is spaced from each other.

13. The image recording device according to claim 12, wherein when the stopper is in the protruding position, the stopper protrudes into the common path such that a protruding end of the stopper is closer to a base end of the stopper in a third direction perpendicular to the first direction than the nip position of the first roller and the second roller.

14. The image recording device according to claim 12, wherein the shifter is configured to shift the conveyor between the first state and the second state by moving one of the first roller and the second roller.

15. The image recording device according to claim 1, further comprising:

a driving source configured to apply a first driving force to the conveyor such that the conveyor conveys the tray in the first direction;

a first detector configured to detect stoppage of the tray conveyed by the conveyor in the first direction; and a controller configured to control the driving source to stop applying the first driving force to the conveyor when the first detector detects stoppage of the tray.

16. The image recording device according to claim 15, wherein the driving source is configured to further apply a second driving force to the conveyor such that the conveyor conveys the tray in the second direction, and wherein when the first detector detects stoppage of the tray conveyed in the first direction, the controller is configured to control the driving source to stop applying the first driving force to the conveyor and to apply the second driving force to the conveyor.

17. The image recording device according to claim 15, further comprising:

a second detector configured to detect an end of the tray conveyed along the common path in the first direction toward the stopper, and a notifying unit configured to issue a first instruction for moving the insertion guide to the non-guide position and a second instruction for moving the image recording device, wherein the controller is configured to control the notifying unit to issue one of the first instruction and the second instruction based on the time when the first detector detects the stoppage of the tray with reference to the time when the second detector detects the end of the tray.

* * * * *